US010519574B2

(12) United States Patent
Stephan

(10) Patent No.: US 10,519,574 B2
(45) Date of Patent: Dec. 31, 2019

(54) METHOD FOR OPTIMIZING THE PRODUCTION OF A ROTOR SPINNING MACHINE

(71) Applicant: Rieter Ingolstadt GmbH, Ingolstadt (DE)

(72) Inventor: Adalbert Stephan, Beilngries/Paulushofen (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 253 days.

(21) Appl. No.: 15/622,667

(22) Filed: Jun. 14, 2017

(65) Prior Publication Data

US 2017/0362746 A1 Dec. 21, 2017

(30) Foreign Application Priority Data

Jun. 15, 2016 (DE) ..... 10 2016 110 974
Sep. 7, 2016 (DE) ..... 10 2016 116 727

(51) Int. Cl.
*D01H 4/44* (2006.01)
*D01H 1/14* (2006.01)

(52) U.S. Cl.
CPC ..... *D01H 4/44* (2013.01); *D01H 1/14* (2013.01)

(58) Field of Classification Search
CPC ... D01H 4/14; D01H 4/06; D01H 1/16; D01F 11/005
See application file for complete search history.

(56) References Cited

U.S. PATENT DOCUMENTS 3,665,696 A * 5/1972 Gubinsky ..... D01H 1/305 242/159
3,855,772 A * 12/1974 Burlet ..... D01H 4/30 57/400
4,094,133 A * 6/1978 Furrer ..... D01H 4/42 361/194

(Continued)

FOREIGN PATENT DOCUMENTS

DE 10 2004 053 505 A1 5/2006
DE 10 2011 112 364 A1 3/2013

(Continued)

OTHER PUBLICATIONS

German Patent Office Search Report, dated Feb. 3, 2017.
EPO Search Report, dated Nov. 27, 2017.

*Primary Examiner* — Shaun R Hurley
*Assistant Examiner* — Bao-Thieu L Nguyen
(74) *Attorney, Agent, or Firm* — Dority & Manning, P.A.

(57) ABSTRACT

A method optimizes production of a rotor spinning machine having a plurality of identical spinning units, with each spinning unit having a spinning rotor driven by a rotor drive at a rotor speed to produce yarn at a delivery speed. A permissible range with a minimum delivery speed and a maximum delivery speed for the delivery speed of the spinning units is specified. Operation of the spinning units is started with a starting delivery speed within the permissible range. Current production capacity of the spinning units or the rotor spinning machine is continuously calculated. Current delivery speed of the yarn is regulated as a function of the current production capacity in such a manner that a maximum production capacity is achieved. A rotor spinning machine in accordance with method is also provided.

16 Claims, 2 Drawing Sheets

(56) References Cited

U.S. PATENT DOCUMENTS 4,288,975 A * 9/1981 Yoshida ..... D01H 4/44 57/263
4,316,357 A * 2/1982 Le Chatelier ..... D01H 1/305 242/478.6
4,359,858 A * 11/1982 Wolf ..... D01H 9/14 242/478.6
4,538,408 A * 9/1985 Baltsch ..... D01H 4/50 57/263
4,598,539 A * 7/1986 Stahlecker ..... B65H 51/205 57/263
5,027,594 A * 7/1991 Gamberoni ..... D01H 4/32 57/203
5,048,281 A * 9/1991 Dallmann ..... D01H 1/115 57/264
5,152,132 A * 10/1992 Strobel ..... D01H 4/12 57/263
5,166,582 A * 11/1992 Jaeger ..... D01H 4/42 318/45
5,243,812 A * 9/1993 Strobel ..... D01H 4/50 57/105
5,431,006 A * 7/1995 Schuller ..... D01H 4/08 57/1 R
5,495,113 A * 2/1996 Badiali ..... D01H 13/165 250/559.45
5,511,371 A * 4/1996 Kaufmann ..... D01H 13/32 57/264
5,528,798 A * 6/1996 Strobel ..... D01G 23/00 19/0.25
5,551,223 A * 9/1996 Nickolay ..... D01H 13/32 57/1 R
5,740,666 A * 4/1998 Yamaguchi ..... D01H 7/58 57/100
5,950,412 A * 9/1999 Gabalda ..... D01H 13/30 57/290
6,009,698 A * 1/2000 Dinkelmann ..... D01H 13/04 57/264
6,298,648 B1 * 10/2001 D'Agnolo ..... D01H 7/86 57/100
6,536,199 B2 * 3/2003 Wortmann ..... D01H 1/16 57/264
6,574,526 B1 * 6/2003 Gaukler ..... D01H 1/16 700/139
7,082,746 B2 * 8/2006 Brandl ..... D01H 4/48 57/263
7,516,606 B2 4/2009 Schaeffler
8,079,207 B2 * 12/2011 Galan Llongueras ... D01H 1/02 57/264
8,256,199 B2 * 9/2012 Schlagenhaft ..... D01H 1/10 57/264
9,353,463 B2 * 5/2016 Stahlecker ..... D01H 4/48
9,873,959 B2 * 1/2018 Stephan ..... D01H 4/50
2002/0014065 A1 * 2/2002 Pujol ..... D01H 1/162 57/75
2003/0110753 A1 * 6/2003 Galan Pujol ..... D01H 1/106 57/58.49
2007/0299591 A1 * 12/2007 Goering ..... A01D 46/085 701/50
2008/0041029 A1 * 2/2008 Schaeffler ..... D01H 1/115 57/264
2008/0243288 A1 * 10/2008 Grecksch ..... D01H 4/42 700/109
2008/0308664 A1 * 12/2008 Vega ..... B65H 59/384 242/364.7
2014/0360151 A1 * 12/2014 Meyer ..... D01H 1/14 57/308
2015/0082766 A1 * 3/2015 Stahlecker ..... D01H 1/115 57/333
2016/0160398 A1 * 6/2016 Yano ..... D01H 1/115 57/328
2017/0130368 A1 * 5/2017 Raisich ..... D01H 1/103
2017/0130369 A1 * 5/2017 Raisich ..... D01H 1/103
2017/0175299 A1 * 6/2017 Stephan ..... D01H 4/50

FOREIGN PATENT DOCUMENTS

DE 102011112364 A1 * 3/2013 ..... D01H 4/44
EP 2 671 983 A2 12/2013
EP 2 982 632 A1 2/2016
WO WO 2016/074767 A1 5/2016

* cited by examiner

METHOD FOR OPTIMIZING THE PRODUCTION OF A ROTOR SPINNING MACHINE

FIELD OF THE INVENTION

The present invention relates to a method for optimizing the production of a rotor spinning machine with a multiple number of identical spinning units each having a spinning rotor. During the operation of the rotor spinning machine, the spinning rotors are driven by at least one rotor drive and each rotate with one rotor speed, whereas each of the spinning units provides a yarn with one delivery speed. The invention also relates to a corresponding rotor spinning machine.

BACKGROUND

In modern rotor spinning machines, there is always the demand for the highest possible production capacity, in order to be able to optimally utilize the spinning machine and to operate it in a cost-effective manner. Therefore, attempts were made in the prior art to be able to increase the rotor speed and thus the delivery speed, and thus to achieve higher production. However, such an increase in the production speed is limited by the increase in the delivery speed, since an increase in the delivery speed also always entails a reduction in machine efficiency, which in turn reduces production capacity. For example, a higher delivery speed also leads to an increase in the thread breakage frequency, and thus to a temporary failure of the spinning unit. As such, with known spinning machines, the delivery speed was adjusted manually based on previous experience, in such a manner that reasonable machine efficiency was obtained. Thereby, whether good production can be achieved through the manual selection of the delivery speed depends both on the experience of the operator and on a multitude of other influences that are not always foreseeable.

As such, in order to increase the production capacity of an open-end rotor spinning machine, DE 10 2011 112 364 A1 proposes to detect the number of thread breaks on the rotor spinning machine, and to automatically adjust the rotational speed of the spinning rotors as a function of the respectively determined thread breakage rate. The thread breakage rate should always be within a predetermined desired range, and below a maximum thread breakage rate. The maximum acceptable thread breakage rate arises from the quality requirements of the respectively produced yarn and from the capacity of the rotor spinning machine to eliminate thread breaks. As a result, a high-quality yarn can be produced with good productivity of the rotor spinning machine. Since, when the maximum permissible thread breakage rate is exceeded, the rotational speed of the spinning rotors is always reduced and production is thus limited, the yarn production capacity of the rotor spinning machine cannot be utilized in an optimum manner.

SUMMARY OF THE INVENTION

Therefore, the task of the present invention is to propose a method for operating a rotor spinning machine, with which the production of the rotor spinning machine can be further improved. Furthermore, a corresponding rotor spinning machine is to be proposed. Additional objects and advantages of the invention will be set forth in part in the following description, or may be obvious from the description, or may be learned through practice of the invention.

With a method for optimizing the production of a rotor spinning machine with a multiple number of identical spinning units each having a spinning rotor, during the operation of the rotor spinning machine, the spinning rotors are driven by at least one rotor drive and each rotate with one rotor speed. Thereby, each of the spinning units provides a yarn with one delivery speed. A corresponding rotor spinning machine features a multiple number of identical spinning units each having a spinning rotor and at least one rotor drive, by means of which the spinning rotors can be driven with a variable rotor speed during the operation of the rotor spinning machine. Furthermore, the rotor spinning machine features a draw-off device, by means of which a produced yarn can be removed from the spinning units with one delivery speed.

It is now provided that a permissible range with a minimum delivery speed and a maximum delivery speed is specified for the delivery speed of the spinning units, and that the spinning units are set during operation with a starting delivery speed within the permissible range. Furthermore, the current production capacity of the spinning units and/or the spinning machine is continuously calculated, and the current delivery speed is tracked as a function of the current production capacity, in such a manner that maximum production capacity is always achieved. For this purpose, means are provided for the rotor spinning machine, by means of which the current production capacity of the spinning units and/or of the spinning machine can be continuously calculated. Furthermore, a control and/or regulating unit is provided, by means of which the delivery speed of the spinning units can be automatically regulated within a permissible range with a minimum delivery speed and a maximum delivery speed, such that maximum production capacity is always achieved. Thereby, the production capacity can be detected individually for each spinning unit, for groups of spinning units or even for the entire spinning machine. Likewise, depending on the type of construction of the spinning machine (among other things), the regulation of the delivery speed can be effected individually for each spinning unit, for groups of spinning units or even for the entire spinning machine.

In this case, the production capacity of a spinning unit or a rotor spinning machine is understood to mean the total production of yarn in kilograms per hour or in terms of units of length or mass per unit of time. The delivery speed of a spinning unit is understood to mean the speed in meters per minute, by means of which the yarn is drawn off from the spinning unit.

Given the fact that, according to the present invention, yarn production is continuously calculated in kilograms per hour or unit of time, it is possible to track the delivery speed during ongoing operation and thereby always adjust it in such a manner that maximum production capacity is achieved. It is therefore not necessary, as in the prior art, to set a maximum permissible thread breakage rate; rather, the delivery speed can be further increased despite a high thread breakage rate. The delivery speed is slightly reduced only if, with an increasing delivery speed, a drop in production capacity is determined, such that the machine can then be operated with this value until a drop in the production capacity requires a new adjustment of the delivery speed.

Since, through the continuous calculation of the production capacity, not only the thread breakage rate, but also a multiple number of other factors that influence machine efficiency (such as, for example, maintenance frequency and the like), are taken into account in the setting of an optimum delivery speed, it is thus possible to always operate the individual spinning unit or rotor spinning machine close to its theoretically possible optimum degree of efficiency. Herein, it is particularly advantageous that not only factors of the spinning machine themselves, but also influences such as the climatic environment or the spinning conditions along with influences of the fiber material to be spun, can be taken into account. In doing so, problems that otherwise entail an increase in the delivery speed, such as an increased need for maintenance, increased thread breakage rates, and the like, can nevertheless be avoided.

On the other hand, according to an alternative design of the invention, the current energy consumption of the spinning units and/or the rotor spinning machine, and not the current production capacity, is continuously calculated. In this case, a permissible range with a minimum delivery speed and a maximum delivery speed is in turn set for the delivery speed of the spinning units, and the spinning units are put into operation with a starting delivery speed located within the permissible range. Herein, the current delivery speed is tracked as a function of the current energy consumption, in such a manner that minimum energy consumption is always achieved. At the spinning unit or at the rotor spinning machine, means are provided for this purpose, by means of which the current energy consumption of the spinning machine can be continuously calculated. Furthermore, a control and/or regulating unit is provided, by means of which the delivery speed of the spinning units can be automatically regulated within the permissible range with a minimum delivery speed and a maximum delivery speed, in such a manner that minimum energy consumption is always achieved. Here as well, the energy consumption for each spinning unit can be detected individually, for groups of spinning units or even for the entire spinning machine, and the delivery speed can be controlled collectively for each spinning unit individually, for groups of spinning units or even for the entire spinning machine.

Herein, the energy consumption of a rotor spinning machine is understood to mean the energy consumption in kWh per kilogram of yarn produced or per meter of yarn produced. Thus, it is necessary to determine, in addition to the current power consumption, the corresponding current mass in kg or quantity in m of yarn produced.

Given the fact that, according to the present invention, the energy consumption is continuously calculated in kilowatt hours per kilogram of yarn, it is possible to produce a certain amount of yarn with a minimum energy expenditure, but still with good quality. This is particularly advantageous if, due to local conditions, only a limited amount of energy is available or the energy consumption has to be reduced for reasons of cost. In this case, the delivery speed is in turn lowered from a starting delivery speed until a minimal energy requirement is reached, and is once again increased only when the minimum delivery speed has been reached or when the energy consumption has increased, for example, due to increased disruptions at a low delivery speed.

Here, it is particularly advantageous if the spinning units and/or the rotor spinning machine is/are optionally operated either with the maximum production capacity or with the minimum energy consumption. For this purpose, the current production capacity and/or the current energy consumption are continuously calculated. At the spinning units and/or at the rotor spinning machine, means are provided, by means of which the current production capacity and/or the current energy consumption can be continuously calculated, and the spinning unit and/or the rotor spinning machine can be driven by the control and/or regulating unit that is freely selectable with the maximum production capacity or with the minimum energy consumption. This allows the machine to be used flexibly depending on the local or temporary conditions and limitations. Thus, the machine can be operated with the maximum production capacity, if energy is available in sufficient quantities and at reasonable prices. However, the machine can also be operated with the minimum energy requirement if, for example, increased electricity prices have to be paid at certain times. In doing so, the current production capacity and the current energy consumption are preferably displayed. An operator can simply decide according to which of the two setting options—production capacity or energy consumption—the rotor spinning machine should be operated.

The machine can also be operated in accordance with a mixed optimization goal or with a weighted partial optimum of the maximum production capacity and the minimum energy consumption. Preferably, the respective weighting can thereby be selected. By means of such operation with a weighted partial optimum, the best compromise between high production capacity and low energy consumption can be achieved for each situation.

Thus, for example, the machine can, in principle, be operated with minimum energy consumption, but at the same time a minimum production capacity is prescribed, which cannot be fallen below, since otherwise the production as a whole would become too uneconomical. Likewise, it may be sensible to operate the machine with maximum production capacity, but at the same time to specify a maximum energy consumption, after which no further increase in the delivery speed (and thus the production capacity) should take place.

In this case it is advantageous if, upon the tracking of the current delivery speed of the spinning units, the current delivery speed and the current rotor speed of the spinning rotors are adjusted in such a manner that yarn properties, in particular a yarn twist, of the yarn provided remain largely the same. And "largely the same" here means that, upon the tracking of the delivery speed, the yarn properties always remain within predetermined, permissible limits. Thus, a yarn with a particularly high, uniform quality can be produced at all spinning positions of the rotor spinning machine.

For calculating the current production capacity, it is advantageous if, in addition to the current delivery speed, at least one current thread breakage rate, one current clearer cut rate, along with one current maintenance intervention rate and/or one current maintenance capacity are used. Within the framework of the present application, "maintenance interventions" are understood to mean all interventions at the spinning units that are carried out with the spinning unit at a standstill, such as, for example, rotor cleaning, coil changing and the like. For example, with applications with which a frequent coil change is required, the production capacity can be reduced by frequent coil changes, such that a somewhat lower delivery speed is set and vice versa. By contrast, maintenance capacity is understood to mean the ability to process a certain number of maintenance requests simultaneously. The maintenance capacity depends on the number of operators and/or the number of maintenance devices, the supply of negative pressure and other influencing variables. If a high maintenance capacity is available, good production capacity can be achieved, even with a comparatively high delivery speed and a correspondingly high maintenance intervention rate. Conversely, the production capacity drops if many maintenance operations are required with a low maintenance capacity, such that production capacity can be improved once again by reducing the delivery speed.

For this purpose, preferably, means are provided on the rotor spinning machine, by means of which a thread breakage and/or a clearer cut rate can be determined.

It is likewise advantageous if means are provided, by means of which a maintenance intervention rate can be determined. This can be provided within a control and/or regulating unit of a movable maintenance device or within a control and/or regulating unit of its own spinning unit.

Furthermore, it is advantageous if a wear state of the spinning rotors and/or standstill times of the spinning units are used to calculate the current production capacity. For example, it is possible to increase the delivery speed in the case of spinning rotors that are subject to little wear, in order to further optimize the production capacity, but without causing increased maintenance requirements for the spinning units. For this purpose, means are preferably provided on the rotor spinning machine, by means of which a wear state of the spinning rotors can be determined. For example, the means may comprise a device for detecting the operating time of the respective spinning rotor, from which the wear state of the spinning rotor can be deduced. In the same manner, the rotor spinning machine can have means for detecting standstill times of the individual spinning units, which are then also used to calculate the current production capacity. Such standstill times can arise, for example, due to excessively long waiting times for maintenance processes, or can occur in the case of defective spinning units.

According to a particularly advantageous design of the invention, the current delivery speed and the current rotor speed are automatically set and adjusted by the rotor spinning machine. This ensures that the optimum production capacity is thereby achieved. However, it is equally conceivable for the rotor spinning machine to, on the basis of the current production capacity (which is continuously calculated in accordance with the described criteria), suggest values for the delivery speed and the rotor speed, which must then be confirmed by the operator. It is thereby possible to take into account other factors that influence the production capacity, but that cannot be detected automatically by the rotor spinning machine, such as, for example, climatic conditions of the spinning environment or properties of the fiber material.

Therefore, it is also advantageous if the permissible range of the delivery speed is determined as a function of the maximum permissible rotor speed and/or the respective application and/or the respectively desired quality requirements and/or the climatic conditions of the spinning environment. These can be deposited on the rotor spinning machine by an operator at the start of spinning (for example). Since, in this manner, the permissible range of the delivery speed is determined for a favorable range from the outset, the delivery speed may have to be tracked only by a small amount, and it can be produced from the beginning as close as possible to the maximum possible production capacity of the rotor spinning machine.

It is also particularly advantageous if the delivery speed and the rotor speed are separately set and adjusted for each rotor drive of the rotor spinning machine. For example, a rotor drive along with a drive for the draw-off devices can be provided for each machine side, such that the setting of the delivery speed and the rotor speed takes place for each machine side. It is thereby possible to achieve a maximum level of yarn production for each batch individually, even in the case of a multi-batch application.

It is likewise advantageous if the delivery speed and the rotor speed are set separately for each spinning unit. For this purpose, a rotor drive designed as an individual drive and a drive for the draw-off devices is designed as an individual drive are provided for the individual spinning units. Thus, individual conditions of each individual spinning unit such as thermal conditions, soiling tendency, wear condition of the spinning rotor and the like can be taken into account, such that each spinning unit is operated with an optimized delivery speed and an optimized rotor speed. This in turn optimizes the production capacity of the entire rotor spinning machine.

The rotor spinning machine advantageously includes indicator means, by means of which setting options relating to production capacity and/or energy consumption can be displayed. Furthermore, the rotor spinning machine includes input means, by means of which one or more of the indicated setting options can be selected, and/or by means of which setting values of the setting options can be set. In the simplest case, such setting options may include the selection between the optimization criteria of "maximum production capacity" and "minimum energy consumption". Furthermore, the setting options may include the optimization criterion of "weighted partial optimum," whereas, preferably, the weighting of the two aforementioned optimization criteria can be set as a setting value by means of the input means.

It is also conceivable to display various criteria for calculating the current production capacity, for example the thread breakage rate, clearer cut rate, maintenance intervention rate, maintenance capacity, wear condition of the spinning rotors or standstill times, as selectable setting options. Furthermore, the setting options may include the selection of the quantity to be tracked (delivery speed and/or rotor speed). From the indicated setting options, the operator may in turn select the desired option by means of the input device.

According to an advantageous design of the invention, the desired upper and lower energy consumption limit and/or the desired upper and lower production capacity limit, within which an optimization is to take place, can be set as additional setting values.

BRIEF DESCRIPTION OF THE DRAWINGS

Additional advantages are described on the basis of the following presented embodiments. The following is shown.

DETAILED DESCRIPTION

Figure 1:
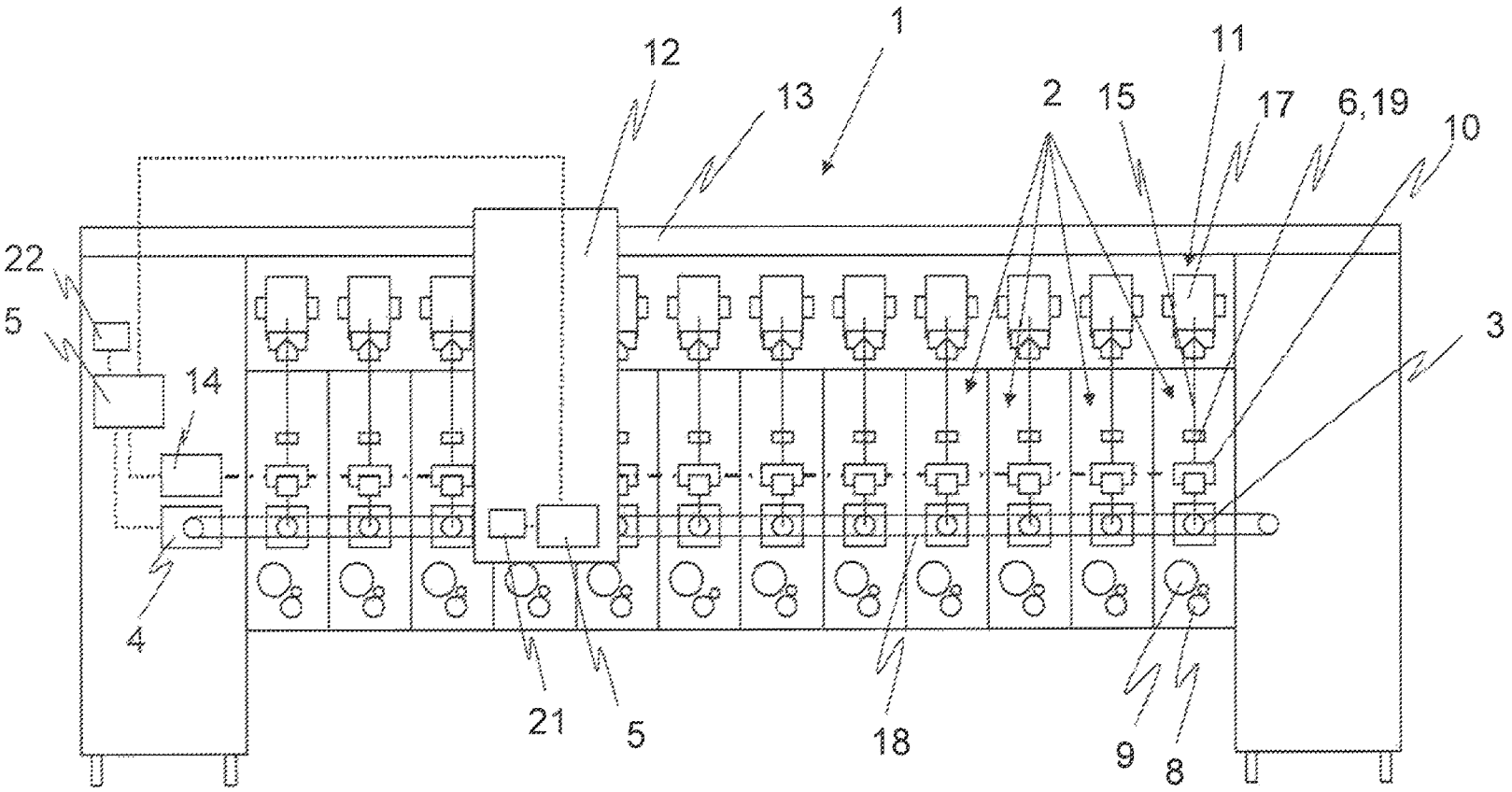
FIG. 1 is a rotor spinning machine according to a first design in a schematic top view.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a rotor spinning machine 1 with a multiple number of spinning units 2 arranged side by side, each having a spinning rotor 3 as a spinning element. Here, a fiber material 16 (see FIG. 2), which is opened into individual fibers in a opening device 9 and fed to the spinning rotor 3, is fed to the spinning units 2 in a conventional manner by means of a feed device 8. The yarn 15 produced in the spinning rotor 3 is subsequently drawn off by a draw-off device 10 at a delivery speed and fed via a yarn monitoring device 6 to a winding device 11, where it is wound onto a coil 17.

In order to drive the spinning rotors 3, according to the design of FIG. 1, a central rotor drive 4 is provided that, by means of a tangential belt 18, drives the spinning rotors 3 of a multiple number of spinning units 2 in a group-by-group manner. In this case, a single rotor drive 4 can be provided for all spinning units 2 of the spinning machine 1, a separate rotor drive 4 can be provided for each side of the rotor spinning machine 1, or the spinning units 2 of the rotor spinning machine 1 can also be divided into groups, each of which is then assigned with a separate rotor drive 4. Furthermore, the rotor spinning machine 1 features a drive 14 for the draw-off devices 10 which, like the rotor drive 4, can be provided as a central drive for all spinning units 2 of the rotor spinning machine or for a group of spinning units 2 of the rotor spinning machine 1. Furthermore, one or more maintenance devices 12, which can be moved on a rail 13, are provided on the rotor spinning machine 1 and carry out maintenance operations at the spinning units 2, such as the repair of thread breaks, thread setting after clearer cuts, coil changing, rotor cleaning and the like.

The rotor spinning machine 1 has a control and/or regulating unit 5, which drives the rotor drive(s) 4 and the drive(s) 14 of the draw-off devices 10 along with additional drives, which are not designated here. The control and/or regulating unit 5 is connected to the maintenance device 12 for controlling or regulating the elements of the maintenance device 12, as indicated by the dash-dotted line. With the present invention, the control and/or regulating unit 5 is provided as a central control and/or regulating unit 5 of the rotor spinning machine 1, and is connected to an additional control and/or regulating unit 5 of the maintenance device 12. However, the maintenance device 12 could likewise be controlled by the central control and/or regulating unit 5 of the rotor spinning machine 1. Furthermore, the control and/or regulating unit 5, which works together with the control and/or regulating unit 5 of the rotor spinning machine 1 and/or the maintenance devices 12, may also feature the individual spinning units 2.

If a thread breakage occurs during the operation of the rotor spinning machine 1, this is registered by the yarn monitoring device 6, the further feeding of the fiber material 16 to the relevant spinning unit 2 is stopped, and the removal of the thread breakage by the maintenance device 12 is initiated. Since the relevant spinning unit 2 does not produce any additional yarn 15 until the thread breakage is corrected, the production capacity of the spinning machine 1 is thereby reduced. The same problem arises if the quality problems of the produced yarn 15 are determined by the yarn monitoring device 6, and a clearer cut is then initiated. Likewise, by means of further maintenance activities of the maintenance device 12, such as coil changing, rotor cleaning, and the like, standstill times of spinning units 2, which have negative effects on production capacity, arise. The problem of reduced production capacity is aggravated even if only a few maintenance devices 12 are present, or if many maintenance requests exist at the same time, resulting in long waiting times at the individual spinning units 2. In addition, not all of the maintenance requests can be remedied by the maintenance devices 12; rather, intervention by an operator is often required.

With the present rotor spinning machine 1, it is therefore provided that the spinning units 2 are not operated at a predetermined, constant delivery speed; rather, the current delivery speed is adjusted as a function of the current production capacity, in such a manner that maximum production capacity is achieved. Means 22 are provided for this purpose, by means of which the current production capacity can be continuously calculated during operation. For this purpose, a corresponding formula is stored in the rotor spinning machine 1, which is used to constantly calculates the current yarn production on the basis of the current delivery speed, the current thread breakage rate, a current clearer cut rate, and a current maintenance capacity or a current maintenance intervention rate. The delivery speed is then always tracked within a previously defined, permissible range starting from a starting delivery speed, in such a manner that maximum production capacity is achieved.

In order to be able to calculate the current production capacity on the basis of the indicated factors, means 19 are provided on the rotor spinning machine 1 in the area of the yarn monitoring device 6, with which the thread breakage rate of the relevant spinning unit 2 can be determined. If the yarn monitoring device 6 is additionally equipped with a yarn cleaning device, the means 19 are also designed to detect a clearer cut rate. In the maintenance device 12, means 21 are also provided, by means of which a maintenance intervention rate can be determined on the rotor spinning machine 1. Thereby, the maintenance intervention rate can be determined as a total maintenance intervention rate for the entire rotor spinning machine 1 or also separately for each individual spinning unit 2. Furthermore, the maintenance capacity can be stored in the control and/or regulating unit 5 of the rotor spinning machine 1 and, if necessary, can also be detected during changes such as, for example, upon the removal of a maintenance device 12 or personnel breaks. The control and/or regulating unit 5 of the rotor spinning machine 1 furthermore has means 21 that, based on the aforementioned data along with the values of the means 18 for determining the thread breakage rate and/or the clearer cut rate along with the means 20 for determining the maintenance intervention rate, determine the current production capacity of the rotor spinning machine 1 on the basis of the stored formula.

The control and/or regulating unit 5 thereupon regulates the current delivery speed by means of the drive 14 in such a manner that maximum production capacity is achieved. This may mean that the delivery speed will be increased if the current production capacity has decreased with respect to a production capacity that was already determined. However, this can also mean that the current delivery speed is reduced if, after an increase in the delivery speed, a drop in production capacity has nevertheless occurred.

According to the present example, the current thread breakage rate, the current clearer cut rate, the current maintenance intervention rate, and the maintenance capacity were used to calculate the current production capacity. However, it is, of course, also possible to use other factors for calculating the current production capacity, such as, for example, a wear condition of the spinning rotors along with standstill times, for which corresponding means for detecting the wear state 19 (see FIG. 2), and means for detecting standstill times are provided. Preferably, not only is the current delivery speed tracked; rather, the rotational speed of the spinning rotors 3 is simultaneously adjusted, such that the yarn twist of the yarn 15 produced remains constant. For this purpose, the control and/or regulating unit 5 is capable of driving the drive 14 of the draw-off devices 10 along with the rotor drive 4 at a variable rotational speed.

Figure 2:
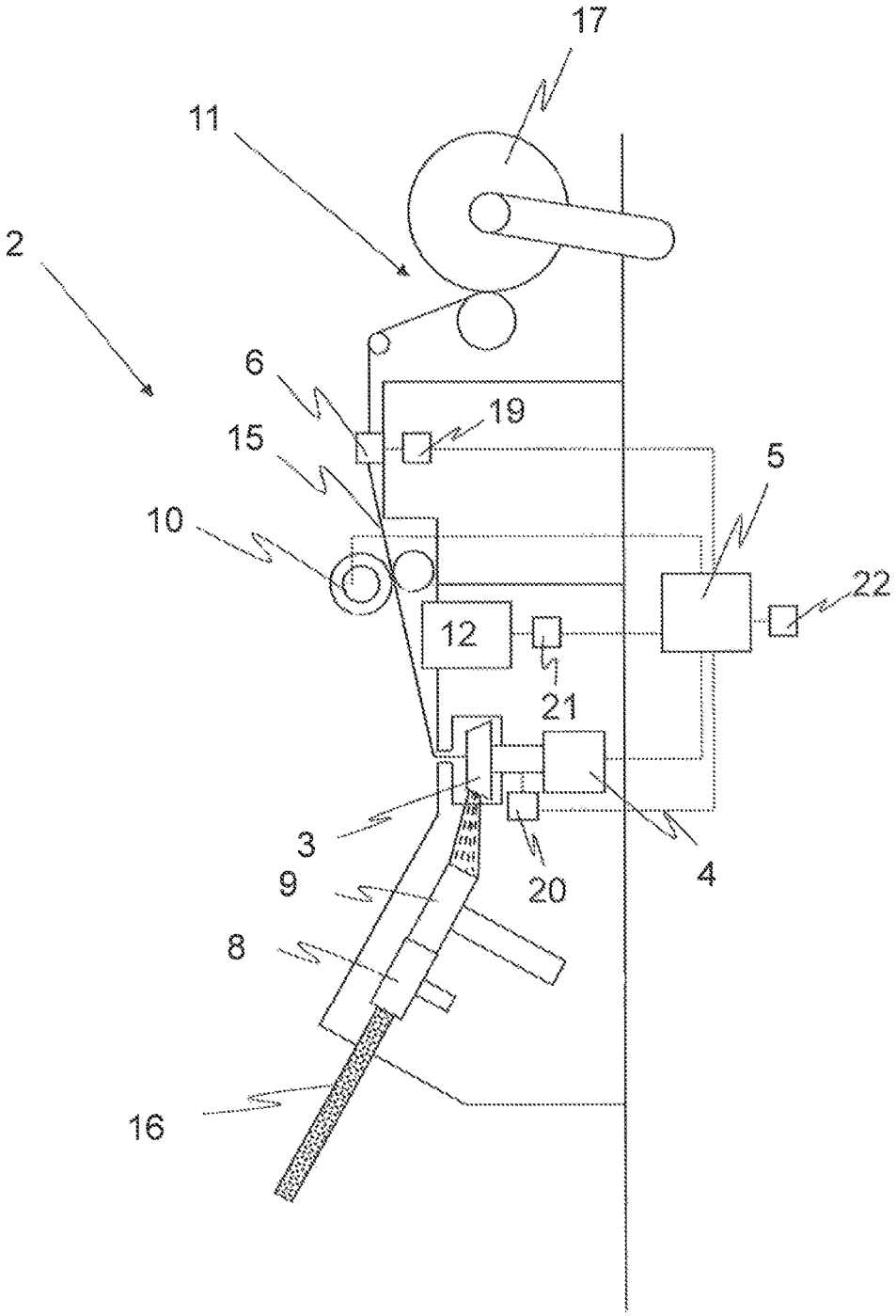
FIG. 2 is a schematic sectional view of a spinning unit of a rotor spinning machine according to a second design.

FIG. 2 shows a spinning unit 2 of an additional design of a rotor spinning machine 1, with which the spinning rotors 3, along with the draw-off devices 10, are not driven by means of central drives, but by means of individual drives. The same components of the spinning unit 2 of FIG. 2 are provided with the same reference signs as in FIG. 1, such that only the differences with the design of FIG. 1 will be discussed in the following. As already explained, each of the spinning rotors 3 of FIG. 2 is driven by means of a rotor drive 4, which is arranged at the spinning unit 2 and designed as an individual drive. Likewise, the draw-off devices 10 are driven by means of a drive 14, which is designed as an individual drive. Furthermore, the means 19 for determining a thread breakage rate and/or a clearer cut rate are shown in the present sectional view of the spinning units 2.

In contrast to the rotor spinning machine 1 of FIG. 1, with the present rotor spinning machine 1, each of the individual spinning units 2 is provided with a maintenance device 12 of its own spinning unit, which is at least able to remedy thread breaks or to spin in again after clearer cuts. Preferably, the maintenance device 12 of its own spinning unit also includes a separate device for rotor cleaning and, if necessary, a separate device for changing the coil. The maintenance device 12 also includes means 21 for determining the maintenance intervention rate in the respective spinning unit 2. In addition, means 20 for determining a wear state of the spinning rotor 3 are arranged at the shown spinning unit 2.

With such a rotor spinning machine 1, it is possible to individually detect the current production capacity for each spinning unit 2, and to optimize it individually at each spinning unit 2 by a corresponding tracking of the delivery speed. The specified means 19, 20, 21 are in turn connected to a control and/or regulating unit 5, which is advantageously provided at each individual spinning unit. The control and/or regulating unit 5 in turn has means 21 for calculating the production capacity, and is able to drive the rotor drive 4 along with the drive 14 of the draw-off device 10, in such a manner that maximum production capacity is always achieved. However, instead of the control and/or regulating unit 5 of its own spinning unit shown here, the control of the drives 4, 14 and the calculation of the production capacity can, of course, also take place in a central control and/or regulating unit 5 of the rotor spinning machine 1. Furthermore, the maintenance capacity of the spinning machine 1 can also be stored in a central control and/or regulating unit 5 and, if appropriate, can be currently detected. Of course, it would also be conceivable to detect the current production capacity or the current energy consumption in each case in a group-by-group manner for a multiple number of spinning units 2, and to control the drives of the spinning machine 1 preferably also in a group-by-group manner, or to provide group drives.

With each of the described designs, it is advantageous if the spinning machine 1 includes indicator means and input means, such that the various available setting options can be indicated to the operator and he is able to select them. The indicator means and input means can be provided, for example, within the control unit 5.

The invention is not limited to the illustrated embodiments. In particular, for example, hybrid forms of the rotor spinning machines 1 shown in FIGS. 1 and 2 are also possible. For example, although rotor drives 4 may be provided as individual drives, as shown in FIG. 2, the maintenance, as in FIG. 1, can be carried out by means of movable maintenance devices 12. Additional variations and combinations within the framework of the claims also fall under the invention.

LIST OF REFERENCE SIGNS

1 Rotor spinning machine
2 Spinning units
3 Spinning rotor
4 Rotor drive
5 Control and/or regulating unit
6 Yarn monitoring device
7 Frame
8 Feed device
9 Severing device
10 Draw-off device
11 Winding device
12 Maintenance device
13 Rail
14 Drive of the draw-off devices
15 Yarn
16 Fiber material
17 Coil
18 Tangential belt
19 Means for determining the thread breakage rate and/or clearer cut rate
20 Means for determining the wear state of the spinning rotor
21 Means for determining the maintenance intervention rate
22 Means for calculating the current production capacity

The invention claimed is:

1. A method for optimizing production of a rotor spinning machine having a plurality of identical spinning units, with each spinning unit having a spinning rotor, and wherein during operation of the rotor spinning machine, the spinning rotors are driven by a rotor drive, rotate at a rotor speed, and provide a yarn at a delivery speed, the rotor spinning machine having one or more control units configured with the spinning units to perform the method, the method comprising:

specifying a permissible range with a minimum delivery speed and a maximum delivery speed for the delivery speed of the spinning units;

starting operation of the spinning units with a starting delivery speed within the permissible range;

continuously monitoring and calculating current production capacity of the spinning units or the rotor spinning machine;

regulating current delivery speed as a function of the current production capacity, in such a manner that a maximum production capacity is achieved, comprising increasing the delivery speed from the starting delivery speed to reach a predetermined production capacity and only decreasing the delivery speed when the increase in delivery speed results in a decrease of the monitored and calculated production capacity; and wherein one or more of the following are used for calculating the current production capacity: current thread breakage rate, current clearer cut rate, current maintenance intervention rate, and maintenance capacity.

2. The method according to claim 1, further comprising:

continuously calculating current energy consumption of the spinning units or the rotor spinning machine; and regulating current delivery speed as a function of the current energy consumption in such a manner that a minimum energy consumption is achieved.

3. The method according to claim 2, wherein the rotor spinning machine is operated to achieve one of: the maximum production capacity, the minimum energy consumption, or a weighted partial optimum of the maximum production capacity and the minimum energy consumption.

4. The method according to claim 1, wherein a desired production capacity range is specified with an upper and a lower production capacity limit, and the current delivery speed is regulated within the desired production capacity range to achieve the minimum energy consumption.

5. The method according to claim 1, wherein a desired energy consumption range is specified with an upper and a lower energy consumption limit, and the current delivery speed is regulated within the desired the desired energy consumption range to achieve the maximum production capacity.

6. The method according to claim 1, wherein for the regulating the current delivery speed, a speed of the rotor and the delivery speed are adjusted to maintain yarn properties unchanged.

7. The method according to claim 1, wherein the permissible range of the delivery speed is determined based on one or more of: a maximum permissible rotor speed; desired yarn quality requirements; and climatic conditions of the spinning environment.

8. The method according to claim 1, wherein the delivery speed and rotor speed are separately set and adjusted for each rotor drive of the rotor spinning machine.

9. The method according to claim 8, wherein each spinning unit comprises an individual drive for the rotor and an individual drive for the draw-off device, wherein the delivery speed and the rotor speed are individually set for each spinning unit.

10. The method according to claim 2, wherein setting options for one or both of the production capacity and the energy consumption are indicated, and wherein the rotor spinning machine is operated in accordance with selection or value of the setting options.

11. A rotor spinning machine, comprising:

a plurality of spinning units, each spinning unit comprising:

a spinning rotor with a rotor drive wherein the spinning rotor is driven with a variable rotor speed during operation of the rotor spinning machine;

a draw-off device by which a produced yarn is removed from the spinning unit at a delivery speed;

wherein a current production capacity of the spinning units or the rotor spinning machine is continuously calculated;

a control unit configured to regulate the delivery speed within a permissible range having a minimum delivery speed and a maximum delivery speed based on the current production capacity in a manner such that a maximum production capacity is achieved;

wherein the control unit is configured to increase the delivery speed from a starting delivery speed to reach a predetermined production capacity and only decrease the delivery speed when the increase in delivery speed results in a decrease of the continuously calculated production capacity; and wherein one or more of the following are used by the control unit to calculate the current production capacity: current thread breakage rate, current clearer cut rate, current maintenance intervention rate, and maintenance capacity.

12. The rotor spinning machine according to claim 11, wherein a current energy consumption of the spinning units or the rotor spinning machine is continuously calculated, the control unit regulating current delivery speed as a function of the current energy consumption in such a manner that a minimum energy consumption is achieved.

13. The rotor spinning machine according to claim 12, wherein the control unit regulates delivery speed to achieve one of: the maximum production capacity, a minimum energy consumption, or a weighted partial optimum of the maximum production capacity and the minimum energy consumption.

14. The rotor spinning machine according to claim 13, wherein a desired production capacity range and a desired energy consumption range are stored in the control unit such that the spinning units are controlled to be within the stored production capacity range with the minimum energy consumption or within the stored energy consumption range with the maximum production capacity.

15. The rotor spinning machine according to claim 12, further comprising indicator by which setting options for one or both of the production capacity and the energy consumption are displayed, and an input by which the setting options are selected or changed.

16. The rotor spinning machine according to claim 11, wherein each spinning unit comprises an individual drive for the spinning rotor and an individual drive for the draw-off device, wherein the delivery speed and the rotor speed are individually set for each spinning unit.

* * * * *